US010851684B2

(12) United States Patent
Feng et al.

(10) Patent No.: US 10,851,684 B2
(45) Date of Patent: Dec. 1, 2020

(54) INVERTED NON-STOP APPARATUS OF MULTI-CYLINDER DIESEL ENGINE FOR FREE-FALL LIFEBOAT

(71) Applicant: JIANGSU UNIVERSITY OF SCIENCE AND TECHNOLOGY, Jiangsu (CN)

(72) Inventors: Xuedong Feng, Jiangsu (CN); Jian Zhang, Jiangsu (CN); Youlin Ling, Jiangsu (CN); Wenxian Tang, Jiangsu (CN); Anlong Sun, Jiangsu (CN); Yongjun Feng, Jiangsu (CN); Dongsheng Liang, Jiangsu (CN); Cheng Chen, Jiangsu (CN); Qiang Li, Jiangsu (CN); Tong Chen, Jiangsu (CN); Xuehui Song, Jiangsu (CN); Wei Zang, Jiangsu (CN); Jun Shi, Jiangsu (CN); Zhongchen Liang, Jiangsu (CN); Xujin Huang, Jiangsu (CN)

(73) Assignee: JIANGSU UNIVERSITY OF SCIENCE AND TECHNOLOGY, Jiangsu (CN)

( * ) Notice: Subject to any disclaimer, the term of this patent is extended or adjusted under 35 U.S.C. 154(b) by 0 days.

(21) Appl. No.: 16/500,093

(22) PCT Filed: Dec. 1, 2017

(86) PCT No.: PCT/CN2017/114184
§ 371 (c)(1),
(2) Date: Oct. 1, 2019

(87) PCT Pub. No.: WO2018/223628
PCT Pub. Date: Dec. 13, 2018

(65) Prior Publication Data

US 2020/0291832 A1 Sep. 17, 2020

(30) Foreign Application Priority Data

Jun. 8, 2017 (CN) ..... 2017 1 0426077

(51) Int. Cl.
*F01M 1/02* (2006.01)
*F01M 13/04* (2006.01)
(Continued)

(52) U.S. Cl.
CPC ..... *F01M 1/02* (2013.01); *F01M 13/04* (2013.01); *F01M 11/0004* (2013.01);
(Continued)

(58) Field of Classification Search
CPC ..... F01M 1/02; F01M 13/04; F01M 11/0004; F01M 2001/123; F01M 2011/0079; F01M 2011/0095
See application file for complete search history.

(56) References Cited

U.S. PATENT DOCUMENTS 8,215,292 B2 * 7/2012 Bryant ..... F02B 33/06 123/559.1
2008/0132129 A1 * 6/2008 Miyata ..... F01M 11/0004 440/88 L

FOREIGN PATENT DOCUMENTS

CN 101392670 3/2009
CN 101660436 3/2010
(Continued)

OTHER PUBLICATIONS

"International Search Report (Form PCT/ISA/210) of PCT/CN2017/114184," dated Feb. 27, 2018, with English translation thereof, pp. 1-6.

*Primary Examiner* — S. Joseph Morano
*Assistant Examiner* — Jovon E Hayes
(74) *Attorney, Agent, or Firm* — JCIPRNET

(57) ABSTRACT

An inverted non-stop apparatus includes a lubricating system and a breathing system. The lubricating system includes
(Continued)

a machine body, an engine oil pump, and an oil pan. A cavity of the oil pan is divided into an oil collection groove and an oil tank body. A flange is provided to form an enclosed lubricating oil tank. The engine oil pump is a double pump including a lubricating pump and an oil return pump. An oil suction port of the oil return pump is connected to the bottom of the oil collection groove, and an oil outlet is connected to the lubricating oil tank. An oil inlet of the lubricating pump is connected to the lubricating oil tank, and an oil outlet is communicated with a main oil path of the machine body. A breathing one-way valve and an air pressure relief valve are provided on the oil tank cover.

9 Claims, 4 Drawing Sheets

(51) Int. Cl.
*F01M 11/00* (2006.01)
*F01M 1/12* (2006.01)

(52) U.S. Cl.
CPC ..... *F01M 2001/123* (2013.01); *F01M 2011/0079* (2013.01); *F01M 2011/0095* (2013.01)

(56) References Cited

FOREIGN PATENT DOCUMENTS

| | | | | | |
|---|---|---|---|---|---|
| CN | 103806977 | | | 5/2014 | |
| CN | 204476502 | | | 7/2015 | |
| CN | 107143395 | | | 9/2017 | |
| CN | 107246296 | | | 10/2017 | |
| CN | 107355278 | | | 11/2017 | |
| CN | 107355280 | | | 11/2017 | |
| CN | 107355280 | A | * | 11/2017 | |
| FM | 107143395 | A | * | 9/2017 | ..... F01M 13/00 |

* cited by examiner

INVERTED NON-STOP APPARATUS OF MULTI-CYLINDER DIESEL ENGINE FOR FREE-FALL LIFEBOAT

BACKGROUND

Technical Field

The present invention relates to an inverted non-stop apparatus of a multi-cylinder diesel engine for a free-fall lifeboat, and in particular, to an inverted non-stop apparatus of a multi-cylinder diesel engine for a free-fall lifeboat, which achieve non-stop free-fall of a lifeboat into water from a free-fall holder of a mother ship under the working state of a diesel engine, and belong to the technical field of marine diesel engines.

Description of Related Art

A lifeboat falls freely from a mother ship, which can greatly improve the efficiency of lifesaving. The technology is increasingly being valued and used by people. However, a selected lifeboat main engine is an inverted stop diesel engine. That is, the diesel engine starts to ignite after the lifeboat enters water and is straightened automatically, which wastes some valuable lifesaving time. Therefore, the quick performance of a free-fall lifeboat is also restricted.

At present, according to an inverted non-stop apparatus of a diesel engine for a lifeboat, when the lifeboat is turned over and inverted, there is not only a problem that a diesel engine can only be turned over around an axis parallel to a crankshaft axis, that is, the lifeboat can only be turned over transversely, but also a problem of engine oil leakage when the diesel engine is turned over and inverted. Although the diesel engine complies with the revised Recommendation on Lifesaving Equipment Testing, passed by the International Maritime Organization's International Convention for the Safety of Life at Sea (SOLAS) 2009 and the International Maritime Organization's Maritime Safety Committee MSC.81 (70). "Engine Inversion Test 6.14.6: An engine is fixed to a holder that is rotatable about an axis equivalent to a longitudinal axis of a lifeboat, and a plate is provided under the engine to collect leaking oil for measurement. 6.14.7: The test proceeds according to the following steps: . . . 6.14.7.8: The running engine is rotated clockwise for 180°, held at 180° for 10s, and then rotated clockwise for 180° to complete a turn (comprehensive test step, in which a diesel engine needs to complete the clockwise and counterclockwise rotation for a total of 6 turns during one test). 6.14.8: During the test, the engine should not undergo overheat, work failure, or leakage of oil of over 250 ml when being inverted at any time." However, the requirements for free-fall of a lifeboat diesel engine into water from a mother ship davit under a non-stop state and longitudinal turnover caused by sea wave rolling of the lifeboat during the driving process cannot be met.

It is well known that the condition for ensuring short-time working of the diesel engine under a turnover and inverted state is to provide good lubrication for the diesel engine. The existing lifeboat diesel engine has an inverted non-stop apparatus, such as patent No. 200810154941.5. The apparatus is provided with a main breather mounted on a cylinder head casing and a secondary breather mounted on an advancer cover. The main breather is used for the upright working of a diesel engine, and the secondary breather is used for the inverted working of the diesel engine. In addition, the main structure of the apparatus further includes a partition board between a crankcase and a cavity of an oil pan to seal the crankcase from the cavity of the oil pan. A one-way valve is provided on the partition board. When the diesel engine is upright or a heel is less than or equal to 90°, the one-way valve is in an on state, the crankcase is communicated with the cavity of the oil pan for convenience of oil return of the diesel engine. When the heel of the diesel engine is more than 90°, a valve port of the one-way valve is automatically closed, and the crankcase is separated from the cavity of the oil pan, so as to control engine oil in the cavity of the oil pan to flow into the crankcase, thereby always immersing an engine oil pump oil inlet into the engine oil in the cavity of the oil pan when the diesel engine is turned over and inverted, and keeping the diesel engine lubricated.

The free-fall lifeboat is fixed to a free-fall holder of a mother ship with a boat bow facing down at an inclination angle of 35°-45° between a longitudinal direction of the boat and a horizontal plane. The diesel engine of the lifeboat is fixed to the bottom of a lifeboat cabin with a gear chamber end facing the boat bow and a flywheel end facing a boat stern. When the lifeboat falls freely, the lifeboat straightly falls into water with the boat bow facing down, the diesel engine is turned over longitudinally for about 90° accordingly, and the gear chamber faces down. Therefore, the existing inverted non-stop lifeboat diesel engine is mounted into the free-fall lifeboat, and then the lifeboat is fixed to the free-fall holder of the mother ship. The one-way valve on the partition board of the oil pan has not been cut off, that is, the oil pan and the crankcase of the diesel engine are communicated. Therefore, a part of engine oil in the cavity of the oil pan of the diesel engine will flow into the crankcase and the gear chamber through the valve port of the one-way valve, causing the oil level in the cavity of the oil pan to drop, so that the remaining engine oil in the cavity of the oil pan cannot maintain the lubrication of the whole free-fall process of the diesel engine. The oil storage capacity of the cavity of the oil pan increases, which makes the oil level of the diesel engine rise. The engine oil immerses a secondary breather port of the diesel engine, so that the engine oil flows out of the machine from the secondary breather port, thereby causing engine oil waste and environmental pollution. At present, a general lifeboat inverted non-stop diesel engine has an oil storage capacity of about 5-7 liters in the oil pan. In addition, when the diesel engine falls down freely, the engine oil of the diesel engine that flows from the cavity of the oil pan into the crankcase and a gear chamber cover originally in a fixed state will immerse the secondary breather port of the diesel engine, thereby causing uncontrolled leakage of the engine oil of the diesel engine. Therefore, the structure cannot meet the requirements for use of a free-fall inverted non-stop lifeboat diesel engine.

Based on the above, for a current diesel engine inverted non-stop apparatus, in order to achieve non-stop free-fall of a lifeboat into water from a free-fall holder of a mother ship under a working state of a diesel engine, it is necessary to solve the following problems: 1, the diesel engine cannot be turned over longitudinally; 2, engine oil leaks out when the diesel engine is turned over; and 3, the diesel engine needs to be equipped with dual breathers, that is, the diesel engine is equipped with a main breather and a secondary breather.

SUMMARY

The object of the present invention is to overcome the defects that the existing inverted non-stop lifeboat diesel engine can only be turned over transversely and cannot be turned over longitudinally, engine oil leakage pollution is caused when the diesel engine is turned over, and the diesel engine needs to be equipped with dual breathers, that is, the diesel engine is equipped with a main breather and a secondary breather.

The present invention provides an inverted non-stop apparatus of a multi-cylinder diesel engine for a free-fall lifeboat, which meets the requirements for free-fall of a lifeboat diesel engine into water from a free-fall holder of a mother ship under a non-stop state and longitudinal and transverse turnover and inversion caused by sea wave rolling of the lifeboat during the driving process.

In order to achieve the above object, the present invention is implemented by the following technical solutions.

The inverted non-stop apparatus of a multi-cylinder diesel engine for a free-fall lifeboat includes a lubricating system and a breathing system. The lubricating system includes a machine body, an engine oil pump, and an oil pan provided at the bottom of the machine body. The breathing system is a diesel engine breather. The diesel engine breather is a communication apparatus for communicating a diesel engine crankcase and an air inlet pipe. A partition board is transversely provided in the oil pan to divide a cavity of the oil pan into a left cavity and a right cavity. The left cavity is an oil collection groove, and the right cavity is an oil tank body. A flange is provided at an opening of the oil tank body for fixing an oil tank cover to form an enclosed lubricating oil tank. The engine oil pump is a double pump having oil inlets and outlets independent separately, which is formed by superposing upper and lower layers, the upper layer being a lubricating pump and the lower layer being an oil return pump. An oil inlet of the oil return pump is connected to the bottom of the oil collection groove through a pipeline, and an oil outlet is connected to the interior of the lubricating oil tank through a pipeline. An oil inlet of the lubricating pump is connected to the interior of the lubricating oil tank through a pipeline, and an oil outlet is connected to an inlet of a machine filter through a pipeline. An outlet of the machine filter is communicated with a main oil path of the machine body. The oil tank cover is provided with a breathing one-way valve and an air pressure relief valve. The breathing one-way valve is fixed to the left middle of the oil tank cover.

The object of the present invention may also be further achieved by the following technical solutions.

The engine oil pump is provided in the oil collection groove. An upper end of a pump shaft of the engine oil pump extends out of a pump body and penetrates through a bearing hole in the machine body. A worm gear is further provided at a top end of the pump shaft, and meshes with a worm arranged on a camshaft of the diesel engine. An upper end of the pump body of the engine oil pump is provided with a flange fixed to the machine body.

Both the oil return pump and the lubricating pump are rotor pumps.

For the oil return pump and the lubricating pump, the lubricating pump has a flow of 23-24 liters/min, and the oil return pump has a flow greater than the flow of the lubricating pump by 1-1.5 liters/min The worm gear has 13 teeth, the worm has 13 heads, and an end face modulus is 1.5

The oil return pump includes a long funnel-shaped oil suction port with a filter screen, which is provided on the lower left side of the oil collection groove. A large end of the long funnel-shaped suction port faces the bottom of the oil collection groove.

The lubricating pump includes a flexible oil suction port.

The flexible oil suction port is provided with a funnel-shaped end. A large end of the funnel-shaped end is provided with a filter screen facing always downward. A small end of the funnel-shaped end is connected to a right port of an oil tank B pipe joint on the side of the lubricating oil tank by a metal bellows.

The oil tank body is provided with an oil filling port with an oil filling cover laterally.

The height of the oil filling port is flush with an upper plane of the oil pan.

The lubricating oil tank is a rectangular parallelepiped having a capacity of 8-9 liters and an oil storage capacity of 6-7 liters. A sealing ring is provided between the oil tank body and the oil tank cover.

The oil tank cover inclines down from left to right at an inclination angle $\alpha$ of 2-3°.

The breathing one-way valve has a cylindrical casing with an inner wall and an outer wall that are both in shape of single step, inner diameter and outer diameter of the casing are smaller at upper end than those at lower end, the upper end is an outlet end of the breathing one-way valve, the lower end is an inlet end of the breathing one-way valve, and both the inner and outer of the outlet end are provided with thread.

An external thread of the outlet end fixes the breathing one-way valve to the left middle of the oil tank cover by a nut.

An internal thread of the outlet end is connected to one end of a breathing pipe. The breathing pipe is a 90° bent pipe with a leftward bend. A port of the other end of the breathing pipe is flush with a left side surface of the lubricating oil tank.

The material of the oil pan is an aluminum alloy.

The communication apparatus is a connection pipe connecting the crankcase and the air inlet pipe, the connection pipe has an inner diameter of 8-10 mm, connection ports namely a crankcase port and an air pipe end port are provided at both ends of the connection pipe, the crankcase port is funnel-shaped port, three semi-enclosed partition boards staggered up and down are provided in the funnel-shaped port axially in sequence, an opening of the funnel-shaped port is perpendicular to a horizontal plane, and the air inlet pipe end port is a hinge port.

The connection pipe is a flexible metal bellows.

The advantages and benefits of the present invention are as follows:

It is well known that in order to ensure the short-time working of a diesel engine in a turnover and inverted state, the lubrication thereof and the air pressure balance of a crankcase must be ensured. The present invention separates an engine oil collection function and an engine oil storage function borne by an oil pan of a lifeboat diesel engine. A left oil collection groove bears the engine oil collection function. A right lubricating oil tank bears the engine oil storage function. When the diesel engine is working, a lubricating pump is used to convey, through a machine filter, engine oil in the lubricating oil tank to a main oil path of the diesel engine to lubricate the machine. An oil return pump is also used to convey the engine oil collected in the oil collection groove after lubrication back to the lubricating oil tank for storage. The engine oil of the diesel engine can be recycled. Since the lubricating oil tank used is sealed and has a sufficient design capacity and a flexible oil suction port, it is ensured that the diesel engine can be fully lubricated when being upright, turned over or inverted.

The crankcase of the diesel engine is sealed from the outside of the machine except for the breathing port of the breather. The flow of the oil return pump of the present invention is slightly larger than that of the lubricating pump, so that when the diesel engine is working, there is no oil in the oil collection groove. Therefore, no matter the diesel engine is longitudinally or transversely turned over and inverted, there is no oil in the machine body to enter a funnel-shaped damping breathing port of the breather, and engine oil leakage is avoided. When the diesel engine is upright, turned over or inverted, only one breather is needed to meet the air pressure balance of the crankcase without engine oil leakage. The breather conveys oil and gas in the crankcase into the air inlet pipe of the diesel engine to work on the diesel engine, thereby achieving energy saving and environmental protection emission.

In addition, since the lubricating oil tank is provided in the oil pan, the left upper space in the lubricating oil tank is communicated with the crankcase through the breathing one-way valve to achieve the air pressure balance of the lubricating oil tank. Also, the breathing port of the breathing one-way valve is prevented from being immersed by the engine oil in the lubricating oil tank when the lifeboat is fixed to the free-fall holder or falls freely. By the provision of a safety valve on the oil tank cover, the safety of the lubricating oil tank is ensured.

In the present invention, a worm on a camshaft in the machine body is used to drive a worm gear on a pump shaft of a double engine oil pump to realize the power transmission of the engine oil pump, and the structure is more compact.

The advantages and features of the present invention are illustrated and explained by the following non-limiting description of the preferred embodiments, which are given by way of example only with reference to the drawings.

In the figures: 101, machine body, 102, main oil path, 103, positioning hole, 104, camshaft, 104A, worm, 105, worm gear, 106, bearing, 107, waist flange, 108, screw, 109, oil pump casing, 110, pump shaft, 111, lubricating pump, 112, oil return pump, 114, oil return pump oil suction port, 118, oil pan, 1181, partition board, 1182, oil collection groove, 119, oil-way distribution block, 122, oil tank A pipe joint, 123, oil tank B pipe joint, 124, flexible oil pipe, 125, oil tank cover, 126, oil suction port, 127, lubricating oil tank, 127A, oil tank body, 131, air pressure relief valve, 132, breathing one-way valve, 1321, split pin, 1322, steel ball, 1323, casing, 1324, valve, 1325, step, 1326, external thread, 1327, internal thread, 133, breathing pipe, 134, machine filter, 135, overflow valve, 141, oil filling port, and 142, oil filling port cover.

170, breather, 171, air inlet pipe, 172, first combined gasket, 173, first hinge body, 174, hinge screw, 175, connection pipe, 176, breathing port, 178, second hinge body, 179, second combined gasket, 180, cap nut, 181, joint, 183, funnel-shaped damping hood, 184, first upper enclosed partition board, 185, advancer cover, 186, lower enclosed partition board, 186A, oil return hole, 187, second upper enclosed partition board, and 188, gear chamber.

DESCRIPTION OF THE EMBODIMENTS

In order to make the objects and technical solutions of the present invention clearer, the present invention will be further described below in conjunction with the accompanying drawings and embodiments:

Those skilled in the art will appreciate that all terms (including technical and scientific terms) used herein have the same meaning as commonly understood by one of ordinary skill in the art to which the present invention belongs, unless otherwise defined.

"Left, right, up, down, front, and back" as used in the present invention mean that when a reader is facing the drawings, a left side of the reader is left, a right side of the reader is right, an upper side of the reader is up, a lower side of the reader is down, an inner surface of paper in front of the reader is front, and a surface facing the reader is back, rather than the specific limitation of the present invention.

The term "connection" as used in the present invention may be a direct connection between components or an indirect connection between components through other components.

Figure 1:
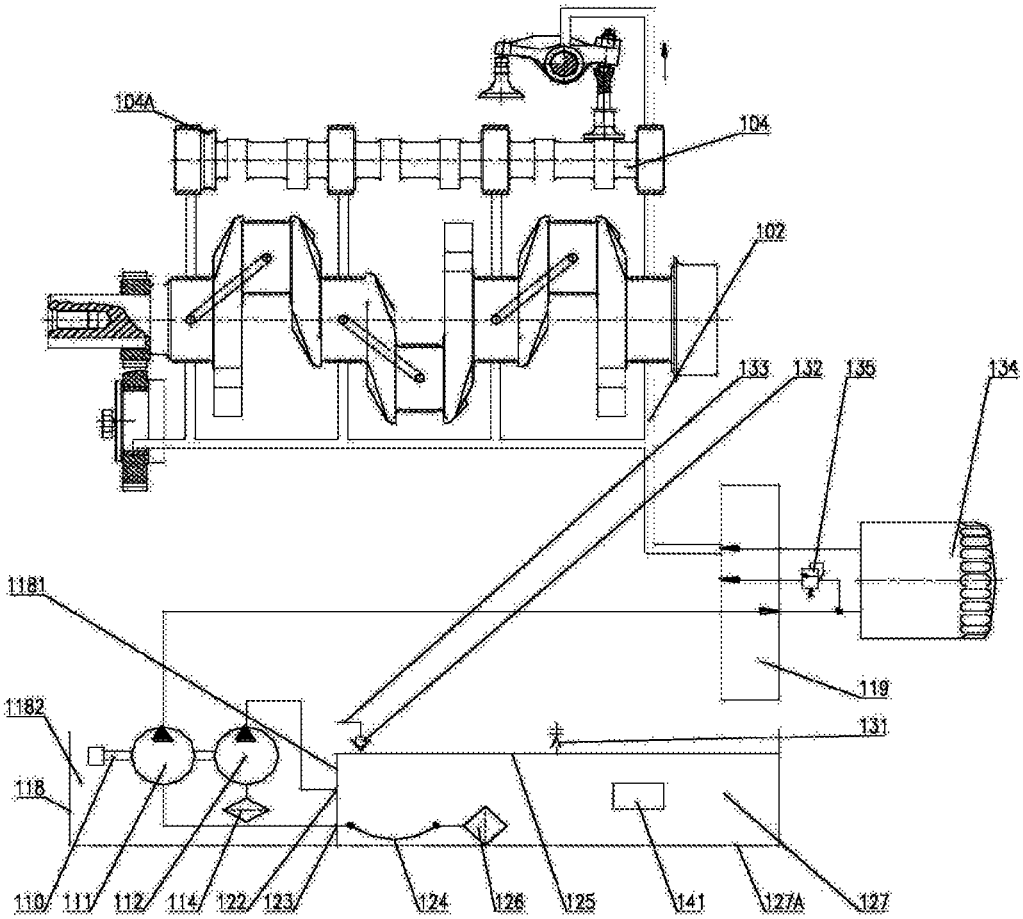
FIG. 1 is a schematic view of a lubricating system of the present invention.
Figure 2:
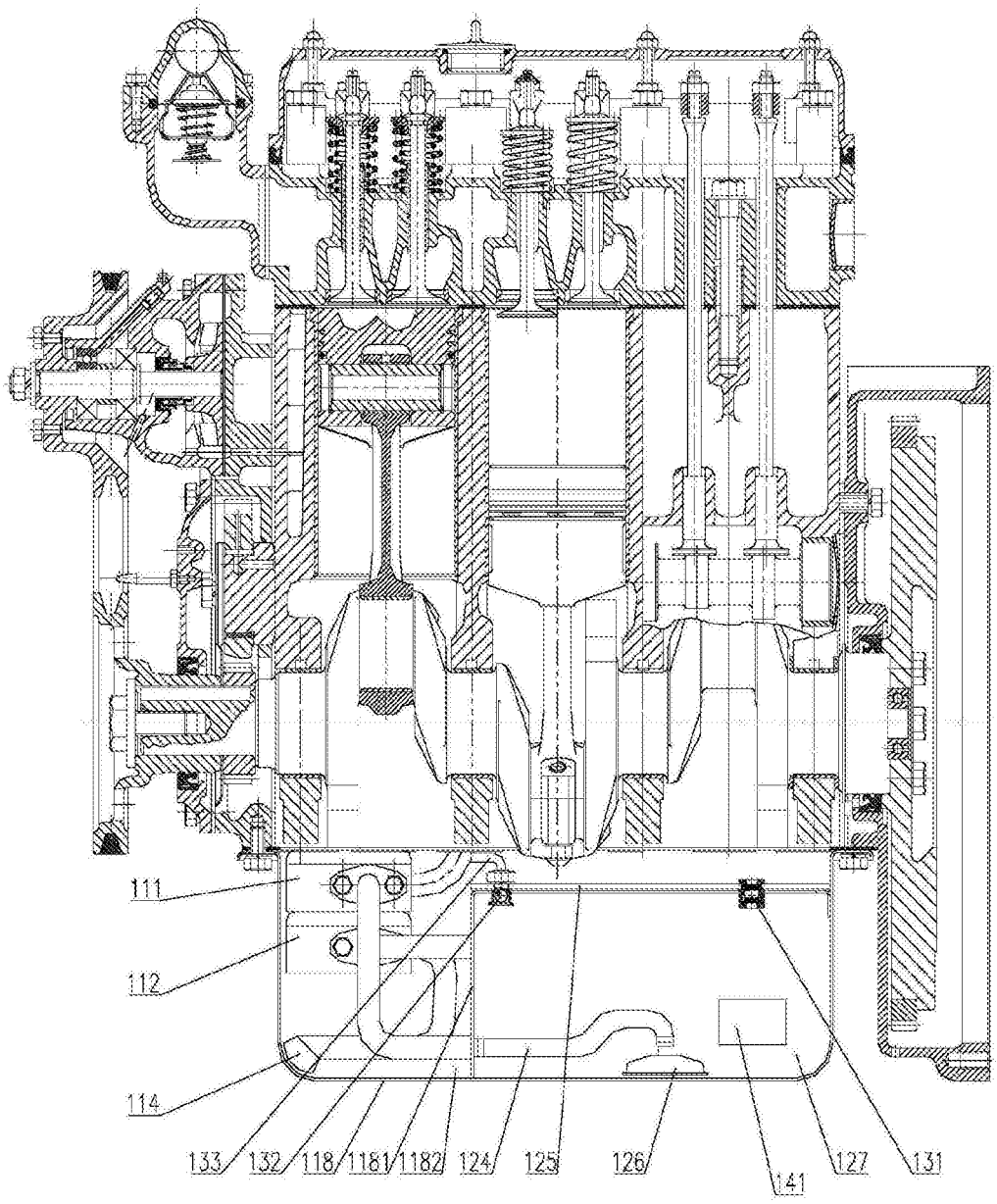
FIG. 2 is a schematic longitudinal sectional view of a diesel engine of the present invention.
Figure 3:
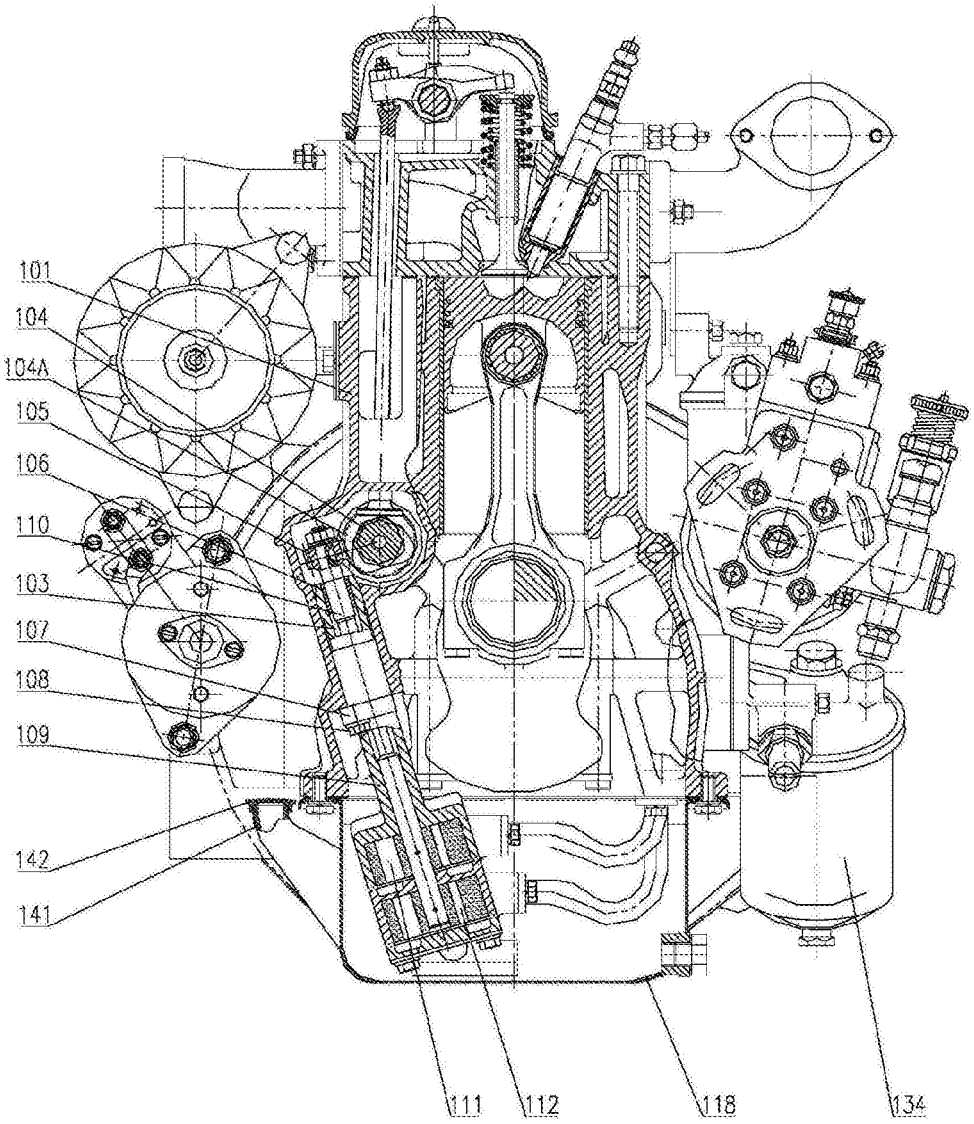
FIG. 3 is a schematic cross-sectional view of a diesel engine of the present invention.

As shown in FIG. 1, FIG. 2 and FIG. 3, a partition board 1181 is transversely provided in an oil pan 118 to divide a cavity of the oil pan into a left cavity and a right cavity, the left cavity being an oil collection groove 1182, and the right cavity being an oil tank body 127A.

An oil filling port 141 is provided in the rear side surface of the oil tank body 127A. An opening of the oil filling port 141 is flush with an upper plane of the oil pan 118. A sealed oil filling port cover 142 is further provided.

An oil tank A pipe joint 122 is provided on the left side surface of the oil tank body 127A, that is, the upper half portion of the partition board 1181 for pipeline connection of an oil outlet end of an oil return pump 112. An oil tank B pipe joint 123 is provided on the lower half portion thereof. A left end of the oil tank B pipe joint 123 allows the pipeline connection of an oil inlet end of a lubricating pump 111. A right end of the oil tank B pipe joint 123 penetrates into the oil tank body 127A and connects a right end of a flexible oil pipe 124.

An opening of the oil tank body 127A is provided with a flange. The flange is used for fixing an oil tank cover 125 and inclines down from right to left at an inclination angle of 2-3° for convenience of collection of engine oil to the oil collection groove 1182. A sealing ring is also provided between the oil tank body 127A and the oil tank cover 125 to form a sealed lubricating oil tank 127. The lubricating oil tank 127 has a capacity of about 8-9 liters and an oil storage capacity of 6-7 liters.

A flexible oil pipe 124 is connected to the right end of the oil tank B pipe joint 123 inside the oil tank body 127A. A funnel-shaped oil suction port 126 having a filter function is connected to the other end of the flexible oil pipe 124. The opening of the oil suction port 126 can be always downward under the action of the gravity as the lubricating oil tank 127 is turned over and inverted, and the oil suction port 126 is maintained at the lower part of the engine oil in the lubricating oil tank 127, thereby ensuring the oil intake of the oil suction port 126 of the lubricating pump 111 when the diesel engine is turned over and inverted, and meeting the lubrication of the diesel engine. The flexible oil pipe 124 is a stainless steel bellows.

A breathing one-way valve 132 is provided in the left middle of the oil tank cover 125. An air pressure relief valve 131 is provided in the middle of the oil tank cover 125.

The air pressure relief valve 131 has a set pressure value of 1,150-1,200 kPa. When air pressure in the lubricating oil tank 127 reaches the value, the air pressure relief valve 131 is automatically opened to exhaust air. When the pressure value drops to 1,120-1,100 kPa, the air pressure relief valve 131 is automatically closed.

Figure 5:
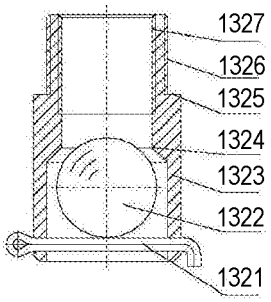
FIG. 5 is a schematic view of a breather one-way valve 132 of the present invention.

As shown in FIG. 5, the structure of the breathing one-way valve 132 includes a cylindrical casing 1323 with an inner wall and an outer wall that are both in shape of single step. An inner diameter and an outer diameter of the casing are smaller at upper end than those at lower end. The lower inner of the casing 1323 is provided with a steel ball 1322 having a diameter smaller than an inner diameter of the casing where the steel ball located in by 2-3 mm. A boundary of the upper and lower inner of the casing 1323 is provided with a circular valve 1324 which can be blocked by the steel ball 1322. The lower end of the casing 1323 is radially provided with a hole penetrating a split pin 1321. Through the blocking of the split pin 1321, the steel ball 1322 is always maintained in the lower inner of the casing 1323 and moves up and down within a distance of about 5-10 mm. By using an external thread 1326 and a step 1325 at the upper end of the casing 1323, the casing 1323 is fixed to the oil tank cover 125 through a nut. An internal thread 1327 is used to connect a breathing pipe 133. The breathing pipe 133 is a 90° bend. One end of the bend is threaded and connected to the internal thread 1327, and a port plane of the other end is flush with the partition board 1181.

The function of the breathing one-way valve 132 is that when the lubricating oil tank 127 is turned over for over 90° or inverted with a lifeboat, the steel ball 1322 blocks a valve 1324 under the action of gravity, and the one-way valve 132 is closed to prevent the engine oil in the lubricating oil tank 127 from flowing into a crankcase in a machine body 101. When the lubricating oil tank 127 is upright, the steel ball 1322 falls back to the lower end of the lower inner hole of the casing 1323. When the turnover angle of the lubricating oil tank 127 with the lifeboat is less than 90°, the amount of engine oil permeating into the crankcase is negligible according to an ideal gas balance equation due to a short time. In addition, since the breathing one-way valve 132 is provided in the left middle of the oil tank cover 125 and the port plane of the other end of the breathing pipe 133 that is the 90° bend is flush with the partition board 1181, it is ensured that the engine oil in the lubricating oil tank 127 does not immerse the breathing one-way valve 132 when the lifeboat is fixed to a free-fall holder or falls freely.

As shown in FIG. 1, FIG. 2 and FIG. 3, an engine oil pump is provided in the oil collection groove 1182. The engine oil pump is a double rotor pump having oil inlets and outlets independent separately, which is formed by superposing upper and lower layers, the upper layer being a lubricating pump 111 and a lower layer being an oil return pump 112. The lubricating pump 111 has a flow of 23-24 liters/min, and the oil return pump 112 has a flow greater than the flow of the lubricating pump 111 by 1-1.5 liters/min.

The oil inlet end of the lubricating pump 111 is connected to the oil tank B pipe joint 123 by using a pipeline. An engine oil outlet route of the lubricating pump 111 is: the oil outlet end of the lubricating pump 111—an oil-way distribution block 119—a machine filter 134—the oil-way distribution block 119—a main oil path 102. Before the engine oil enters the machine filter 134, an overflow valve 135 is provided inside the oil-way distribution block 119. The engine oil pressure of the main oil path 102 is controlled to be 0.3-0.4 Pa. The spilling oil of the overflow valve 135 flows back to the crankcase inside the diesel engine to the oil collection groove 1182, and the lubricating system pressure of the diesel engine is controlled.

A strip-shaped oil return pump oil suction port 114 of the oil return pump 112 is provided on the lower left side of the oil collection groove 1182. The oil outlet end of the oil return pump 112 is connected to the oil tank A pipe joint 122 of the lubricating oil tank 127.

As shown in FIG. 3, the lubricating pump 111 and the oil return pump 112 share a pump shaft 110 and an oil pump casing 109. The pump shaft 110 passes through a positioning hole 103 provided in the machine body 101, and is positioned in a bearing 106. An upper end of the oil pump casing 109 is provided with a waist flange 107. The waist flange 107 is fixed to the machine body 101 by a screw 108. An upper end of the pump shaft 110 is fixed with a worm gear 105 meshing with a worm 104A provided on a camshaft 104. The worm gear 105 has 13 teeth, and the worm 104A has 13 heads, that is, a transmission ratio of 1:1, and an end face modulus is 1.5. Therefore, the engine oil pump of the present invention transmits power through the camshaft 104, and the structure is more compact.

Figure 4:
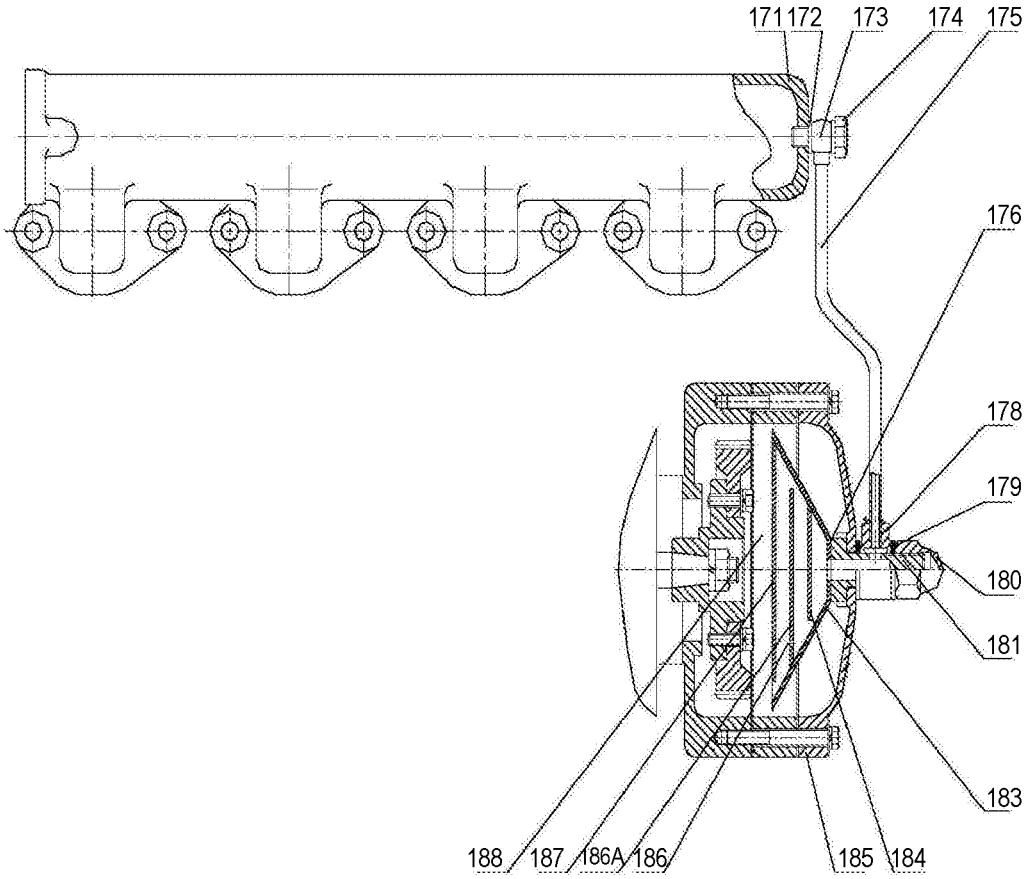
FIG. 4 is a schematic view of a breather of the present invention.

As shown in FIG. 4, a breather 170 is an apparatus for communicating a gear chamber 188 and an air inlet pipe 171 by using a connection pipe 175, where the connection pipe 175 is a flexible metal bellows having an inner diameter of 8-10 mm. An upper end of the connection pipe 175 is provided with a first hinge body 173. The first hinge body 173 is fixed to a right end face of the air inlet pipe 171 through a hinge screw 174 and a first combined gasket 172. A lower end of the connection pipe 175 is provided with a second hinge body 178, connected to a joint 181 of a breathing port 176, and fixed to an advancer cover 185.

The breathing port 176 is composed of the joint 181 and a funnel-shaped damping hood 183, where the joint 181 is a cylinder having a shoulder at one end. An end face of the shoulder is provided with an axial blind hole. A radial hole communicated with the blind hole is provided in the bottom of the blind hole. The funnel-shaped damping hood 183 is provided on the inner side of the advancer cover 185. Three semi-enclosed partition boards staggered up and down are sequentially provided in the funnel-shaped damping hood 183 from a hood bottom to a hood opening, that is, a first upper enclosed partition board 184, a lower enclosed partition board 186 and a second upper enclosed partition board 187. The lower part of the lower enclosed partition board 186 is provided with an oil return hole 186A. An outer end face of the shoulder end of the joint 181 is communicated with the hood bottom of the funnel-shaped damping hood 183, and the other end penetrates from a bowl bottom center hole of the advancer cover 185 from inside to outside, is connected to the second hinge body 178 on an outer end face of the advancer cover 185, and is fixed to the advancer cover 185 through a second combined gasket 179 and a cap nut 180. Since the gear chamber 188 in the advancer cover 185 is communicated with the crankcase of the diesel engine, the air pressure balance of the crankcase of the diesel engine is achieved by using the breather 170.

The test of the present invention includes: firstly, fixing a diesel engine to a rotating frame equivalent to the longitudinal turnover and inversion of the diesel engine, rotating the diesel engine horizontally by 90°, and fixing to a rotating frame equivalent to the horizontal turnover and inversion of the diesel engine. With reference to the revised Recommendation on Lifesaving Equipment Testing, passed by the International Maritime Organization's International Convention for the Safety of Life at Sea (SOLAS) 2009 and the International Maritime Organization's Maritime Safety Committee MSC.81 (70), based on 6.14.7, the test is performed respectively according to the following steps:

1. Start a diesel engine to run at a full speed for 5 min.
2. Stop and rotate clockwise for 360°.
3. Restart the diesel engine to run at a full speed for 10 min.
4. Stop and rotate counterclockwise for 360°.
5. Restart the diesel engine to run at a full speed for 10 min, and then stop.
6. Cool down the diesel engine.
7. Restart the diesel engine to run at a full speed for 5 min.
8. Rotate the running diesel engine clockwise for 180°, keep at a position of 180° for 10 s, and then re-rotate clockwise for 180° to complete a turn.
9. Allow the diesel engine to continue running at a full speed for 10 min.
10. Stop and cool it down.
11. Restart the diesel engine to run at a full speed for 5 min.
12. Rotate the running diesel engine counterclockwise for 180°, keep at a position of 180° for 10 s, and then rotate counterclockwise for 180° to complete a turn.
13. Allow the diesel engine to run at a full speed for 10 min.
14. Stop and cool it down.
15. Restart the diesel engine to run at a full speed for 5 min.
16. Rotate the diesel engine clockwise for 180°, stop the diesel engine, and then rotate for 180° to complete a turn clockwise.
17. Restart the diesel engine to run at a full speed for 10 min.
18. Rotate the diesel engine counterclockwise for 180°, stop the diesel engine, and then rotate for 180° to complete a turn counterclockwise.
19. Restart the diesel engine to run at a full speed for 10 min, and then stop.
20. Disassemble the diesel engine for inspection The longitudinal turnover and inversion and the transverse turnover and inversion tests of the diesel engine are performed. During the tests, the oil pressure of engine oil is 0.3-0.35 MPa, the temperature of the engine oil is 80-90°, the water temperature of cooling water is 70-85°, the ambient temperature is 22°, the diesel engine is running normally, and no oil leakage is found. When the diesel engine is disassembled for inspection, the machine shows no signs of overheating or excessive wear.

What is claimed is:

1. An inverted non-stop apparatus of a multi-cylinder diesel engine for a free-fall lifeboat, comprising a lubricating system and a breathing system, the lubricating system including a machine body, an engine oil pump, and an oil pan provided at a bottom of the machine body, the breathing system being a diesel engine breather, the diesel engine breather being a communication apparatus for communicating a diesel engine crankcase and an air inlet pipe, wherein a partition board is transversely provided in the oil pan to divide a cavity of the oil pan into a left cavity and a right cavity, the left cavity being an oil collection groove, and the right cavity being an oil tank body; a flange is provided at an opening of the oil tank body for fixing an oil tank cover to form an enclosed lubricating oil tank; the engine oil pump is a double pump having oil inlets and outlets independent separately, which is formed by superposing upper and lower layers, the upper layer being a lubricating pump and the lower layer being an oil return pump; an oil inlet of the oil return pump is connected to a bottom of the oil collection groove through a pipeline, and an oil outlet of the oil return pump is connected to an interior of the lubricating oil tank through a pipeline; an oil inlet of the lubricating pump is connected to the interior of the lubricating oil tank through a pipeline, and an oil outlet of the lubricating pump is connected to an inlet of a machine filter through a pipeline; an outlet of the machine filter is communicated with a main oil path of the machine body; the oil tank cover is provided with a breathing one-way valve and an air pressure relief valve; and an inlet end of the breathing one-way valve is provided below the oil tank cover, and an outlet end of the breathing one-way valve is provided above the oil tank cover.

2. The inverted non-stop apparatus of a multi-cylinder diesel engine for a free-fall lifeboat according to claim 1, wherein the engine oil pump is provided in the oil collection groove, an upper end of a pump shaft of the engine oil pump extends out of a pump body and penetrates through a bearing hole in the machine body, a worm gear is further provided at a top end of the pump shaft, and meshes with a worm provided on a camshaft of the diesel engine, and an upper end of the pump body of the engine oil pump is provided with a flange fixed to the machine body.

3. The inverted non-stop apparatus of a multi-cylinder diesel engine for a free-fall lifeboat according to claim 1, wherein the oil return pump comprises a long funnel-shaped oil inlet with a filter screen being provided on a lower left side of the oil collection groove, and a large end of the long funnel-shaped oil inlet faces the bottom of the oil collection groove.

4. The inverted non-stop apparatus of a multi-cylinder diesel engine for a free-fall lifeboat according to claim 1, wherein the lubricating pump comprises a flexible oil inlet.

5. The inverted non-stop apparatus of a multi-cylinder diesel engine for a free-fall lifeboat according to claim 1, wherein the lubricating oil tank is a rectangular parallelepiped having a capacity of 8-9 liters and an oil storage capacity of 6-7 liters, and a sealing ring is provided between the oil tank body and the oil tank cover.

6. The inverted non-stop apparatus of a multi-cylinder diesel engine for a free-fall lifeboat according to claim 1, wherein the breathing one-way valve has a cylindrical casing with an inner wall and an outer wall that are both in shape of single step, an inner diameter and an outer diameter of the casing are smaller at upper end than those at lower end, the upper end is an outlet end of the breathing one-way valve, the lower end is an inlet of the breathing one-way valve, and both inner and outer of the outlet end are provided with thread.

7. The inverted non-stop apparatus of a multi-cylinder diesel engine for a free-fall lifeboat according to claim 6, wherein an external thread of the outlet end fixes the breathing one-way valve to a left middle of the oil tank cover by a nut.

8. The inverted non-stop apparatus of a multi-cylinder diesel engine for a free-fall lifeboat according to claim 1, wherein an internal thread of the outlet end is connected to one end of a breathing pipe, the breathing pipe is a 90° bent pipe, and a port of the other end of the breathing pipe is flush with a left side surface of the lubricating oil tank.

9. The inverted non-stop apparatus of a multi-cylinder diesel engine for a free-fall lifeboat according to claim 1, wherein the communication apparatus is a connection pipe connecting the crankcase and the air inlet pipe, the connection pipe has an inner diameter of 8-10 mm, connection ports namely a crankcase port and an air inlet pipe port are provided at both ends of the connection pipe, the crankcase port is a funnel-shaped port, three semi-enclosed partition boards staggered up and down are provided in the funnel-shaped port axially in sequence, an opening of the funnel-shaped port is perpendicular to a horizontal plane, and the air inlet pipe port is a hinge port.

* * * * *